US006298680B1

(12) United States Patent
Chopko et al.

(10) Patent No.: US 6,298,680 B1
(45) Date of Patent: Oct. 9, 2001

(54) EVAPORATOR COIL WITH INTEGRAL HEATER

(75) Inventors: Robert A. Chopko, Baldwinsville, NY (US); Brigit M. Corman, Germantown, WI (US); Gregory I. Natke, Chittenango, NY (US); Denis L. Sourdin, Mont Saint Aignan (FR)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 09/502,716

(22) Filed: Feb. 11, 2000

Related U.S. Application Data

(63) Continuation-in-part of application No. 09/072,120, filed on May 4, 1998.

(51) Int. Cl.[7] ..... F25D 21/06
(52) U.S. Cl. ..... 62/276

(58) Field of Search ..... 62/276, 275, 525

(56) References Cited

U.S. PATENT DOCUMENTS

| | | | | |
|---|---|---|---|---|
| 2,705,874 | * | 4/1955 | Binder et al. | 62/276 |
| 2,758,150 | * | 8/1956 | Zargarpur | 62/276 |
| 3,783,635 | * | 1/1974 | Perez | 62/276 |
| 4,091,637 | * | 5/1978 | Vogel et al. | 62/276 |
| 5,186,022 | * | 2/1993 | Kim | 62/515 |

* cited by examiner

*Primary Examiner*—Henry Bennett
*Assistant Examiner*—Melvin Jones
(74) *Attorney, Agent, or Firm*—Wall Marjama & Bilinski

(57) ABSTRACT

An evaporator coil for a refrigeration system which includes a plurality of contiguous metal fins which include means for providing conductive heat to the fins on demand or under a predetermined conditions. The heating means care in the form of a plurality of interconnected electrically heated rods which are in direct contact with the outer surface of the fins of the evaporator coil.

2 Claims, 7 Drawing Sheets

(2.5X)

EVAPORATOR COIL WITH INTEGRAL HEATER

CROSS REFERENCE TO RELATED APPLICATION

This is a continuation-in-part of co-pending U.S. application Ser. No. 09/072,120 filed May 4, 1998.

BACKGROUND OF THE INVENTION

The invention relates in general to refrigeration systems and more specifically to means for providing heat to an evaporator coil which is used in a refrigeration system.

A common problem associated with refrigeration systems, such as transport refrigeration units, relates to the evaporator unit and defrosting the evaporator coil in a timely and efficient manner. The prior art has addressed the problem in several ways.

One approach has been to provide for a flow of hot gas over the frosted coil. This method has not proven to be efficient and causes problems with the refrigerant which tends to migrate back to the condenser.

Another method provides for the use of simple electrical resistance, spaced at a fixed distance from the evaporator coils. To provide radiant heat this method, however, fails to provide for defrosting in a timely or even manner.

It can therefore be seen from the above that there is a need in the field for an efficient way in which to effectively defrost an evaporator coil and avoid creating other problems in the refrigeration system.

Accordingly it is an object of the present invention to provide for means which overcome the problems associated with the frosting or icing of evaporator coils for refrigeration systems.

It is another object to provide an efficient and economical means for heating an evaporator coil yet retain the ease of serviceability and replacement of the hearing means.

It is yet another object of the present invention to provide an effective means for providing heat on demand to an evaporator coil.

It is a further object of the present invention to provide heating means which are integral to an evaporator coil which shorten defrost time.

It is another object of the present invention to provide for electrical heating means which defrost a refrigeration evaporator coil in an efficient and timely manner.

SUMMARY OF THE INVENTION

The present invention is directed to an evaporator unit suitable for use in a refrigeration system which includes heating means integral with the evaporator coil to provide conductive electric heat to the coil on demand or under predetermined conditions.

The evaporator coil, which includes a plurality of contiguous metal cooling fins, further includes means for directly providing heat to the cooling fins. The heating means include a plurality of interconnected electrically heated rods which are in direct contact with the outer surface of the cooling fins of the evaporator coil. In one embodiment, the heating means comprises a several elongated electrically heated metal rods which are arranged in an interconnected parallel array in direct contact with an outer surface of the coil. The metal rods may also be partially embedded in the fins of the coil to enhance conductive heat flow to the coil. The metal rods may be electrically connected in pairs by a common electrical connection to provide heat to the coil by electrical resistance. In another embodiment, the metal rods may be sized to fit between the fins of the coil.

DETAILED DESCRIPTION OF THE INVENTION

Figure 1:
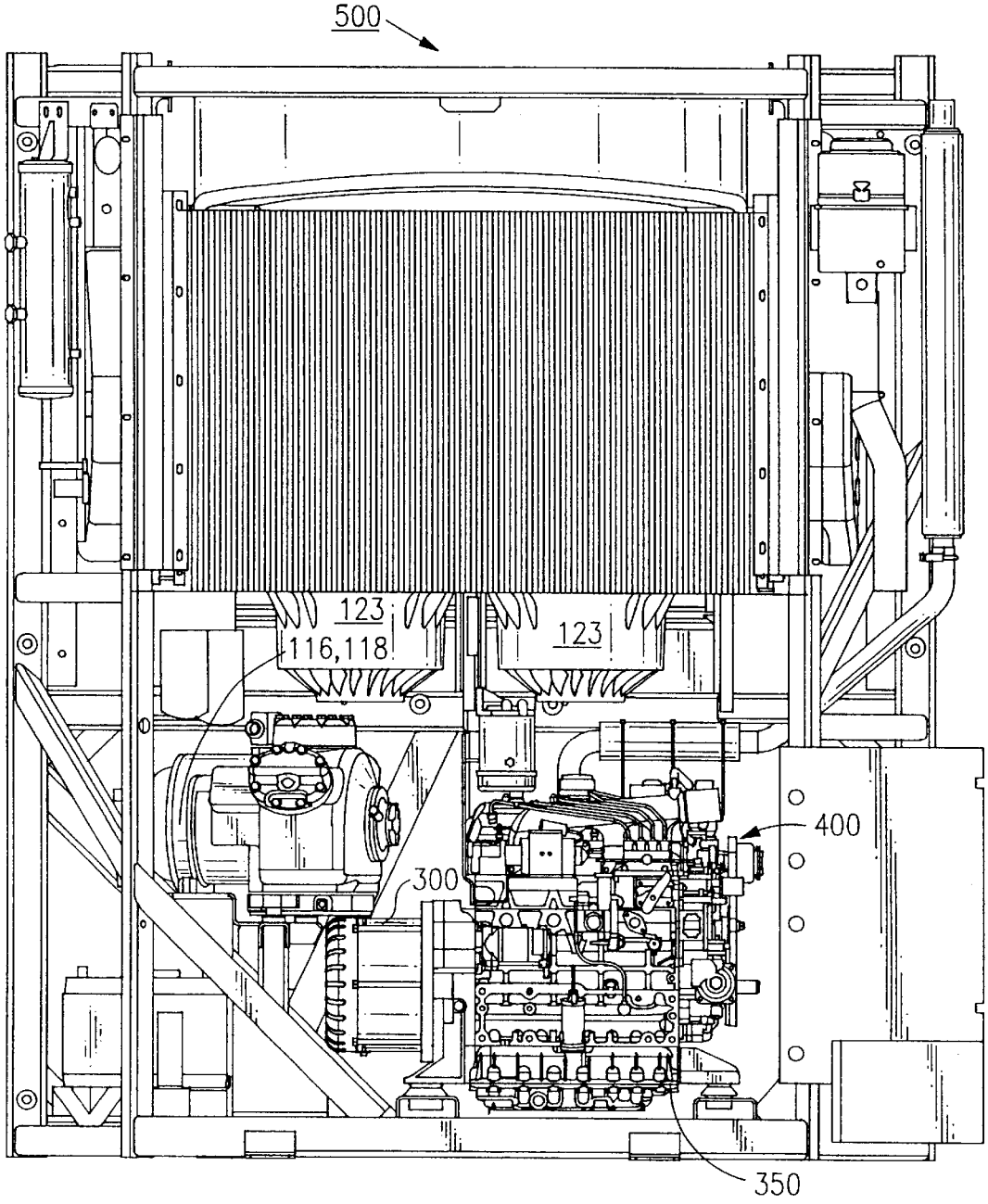
FIG. 1 is a front view of a transport refrigeration system.

FIG. 1 illustrates a transport refrigeration system more particularly known as a trailer refrigeration unit. As shown in FIG. 1, a truck trailer refrigeration unit 500 integrally includes a mounted diesel engine driven generator 300 and the diesel engine 350 in accordance with a system which may use one embodiment of the present invention. The truck trailer refrigeration unit 500 has the compressor/drive motor unit 116, 118 and other refrigeration system components. All multi-phase power, single phase power and control system power for the refrigeration unit 500 is provided by the single integrally mounted diesel engine driven generator 300 and associated voltage, current, and frequency controls. The internally mounted diesel engine driven generator 300 also provides the necessary higher voltage ac power to the electrically driven compressor/motor unit 116, 118, electrically driven evaporator fans, the electrically driven condenser fans 123 and a host of high power consumption devices such as heaters.

Figure 2:
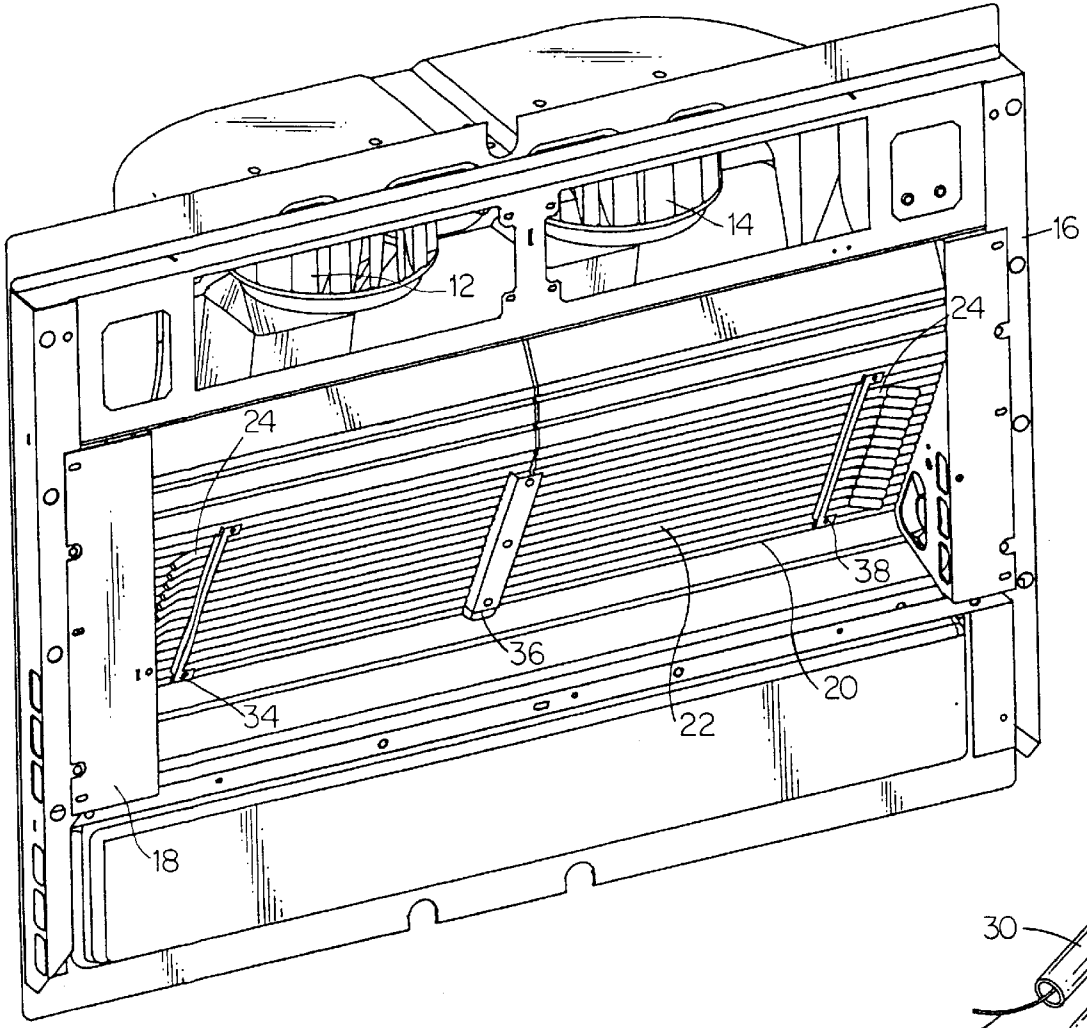
FIG. 2 is a perspective view of an evaporator coil unit suitable for use in a refrigeration system.

The present invention is illustrated more clearly in FIGS. 2–5. FIG. 2 illustrates an evaporator unit 10 which includes a pair of fans 12 and 14 contained within an outer support frame 16. Frame 16 contains an inner mounting frame 18 which contains coil evaporator 20. Coil 20 is made up of a plurality of interconnected spaced metal fins 22. Separate and apart from the coil are a plurality of interconnected electrically heated rods 24 which are in direct contact with coil fins 22. Metal brackets 34, 36, and 38 function to hold the coil in place within the evaporator unit. The combination of the coil evaporator and interconnected electrically heated rods is called an evaporator coil assembly.

Figure 3:
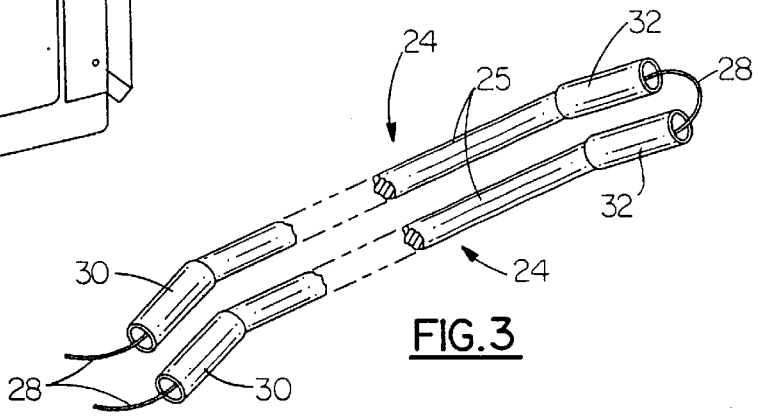
FIG. 3 is a perspective view of a pair of electrically heated rods.

As shown more clearly in FIG. 3, each rod 24 is formed as a tube 25 enclosing an electrical conductor 28, the conductor 28 dissipating heat according to Joule's law (wherein the heat generated is inversely proportional to the resistance of the conductor for a given voltage). The conductor 28 is preferably connected at one end via a connector 30 to a suitable source of electrical power, and runs through enclosed tube 25 to an electrical connector 32, and connects to another tube via an electrical connector 32, and run through that other tube to another connector 30 that connects the conductor to the electrical power ground, or another electrical phase (not shown). Alternatively, rather than each conductor passing through two separate serial rods and thus efficiently connecting proximately to the source and ground, each conductor may be connected at one rod end to the electrical power source and at the other rod end to ground or another electrical phase, and thus routing through only a single rod. In accordance with Joule's law, the resistance per length of each conductor is selected according to the chosen heat generation of each road, the length of each conductor, and the current constraints of the voltage source. Each tube 25 comprises a material that efficiently conducts heat from the conductor to the contacted fin and at the same time protects the enclosed conductor from deleterious environmental contact. The tube material is ceramic, or alternatively metallic wherein the conductor is surrounded by a thin heat conducting dielectric between the metallic tube and the conductor.

Figure 4:
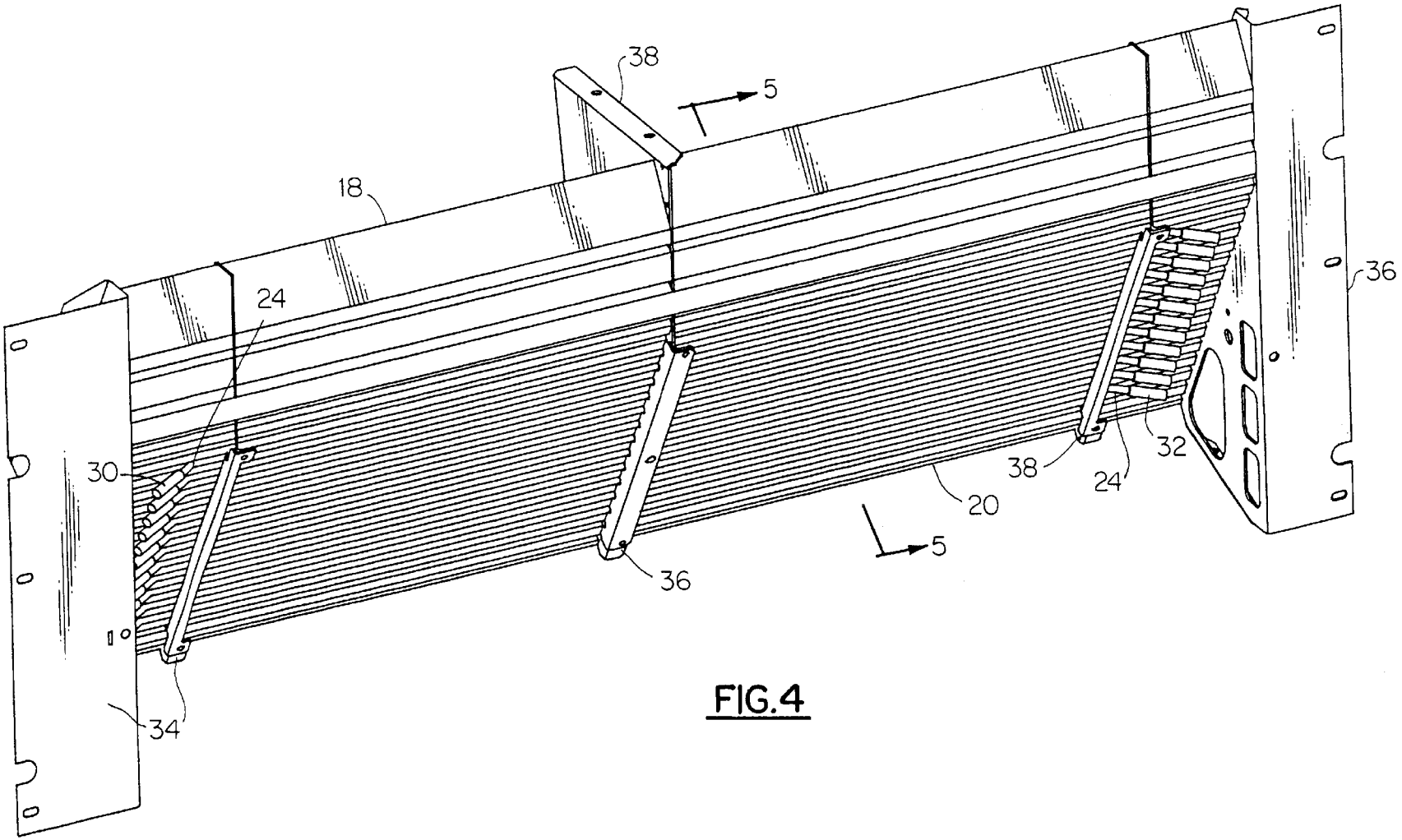
FIG. 4 is an enlarged view of the evaporator coil and mounting frame of FIG. 2.

As shown more clearly in FIG. 4, mounting frame 18 contains side mounting brackets 34 and 36 and top mounting bracket 38 which hold the coil in place within the evaporator unit. The electrically heated rods are arranged in a parallel array such that they are in direct contact with the coil fins in order to maximize conductive heat flow to the coil, when needed, and provide an integral fit either in or between the fins as desired.

Figure 5:
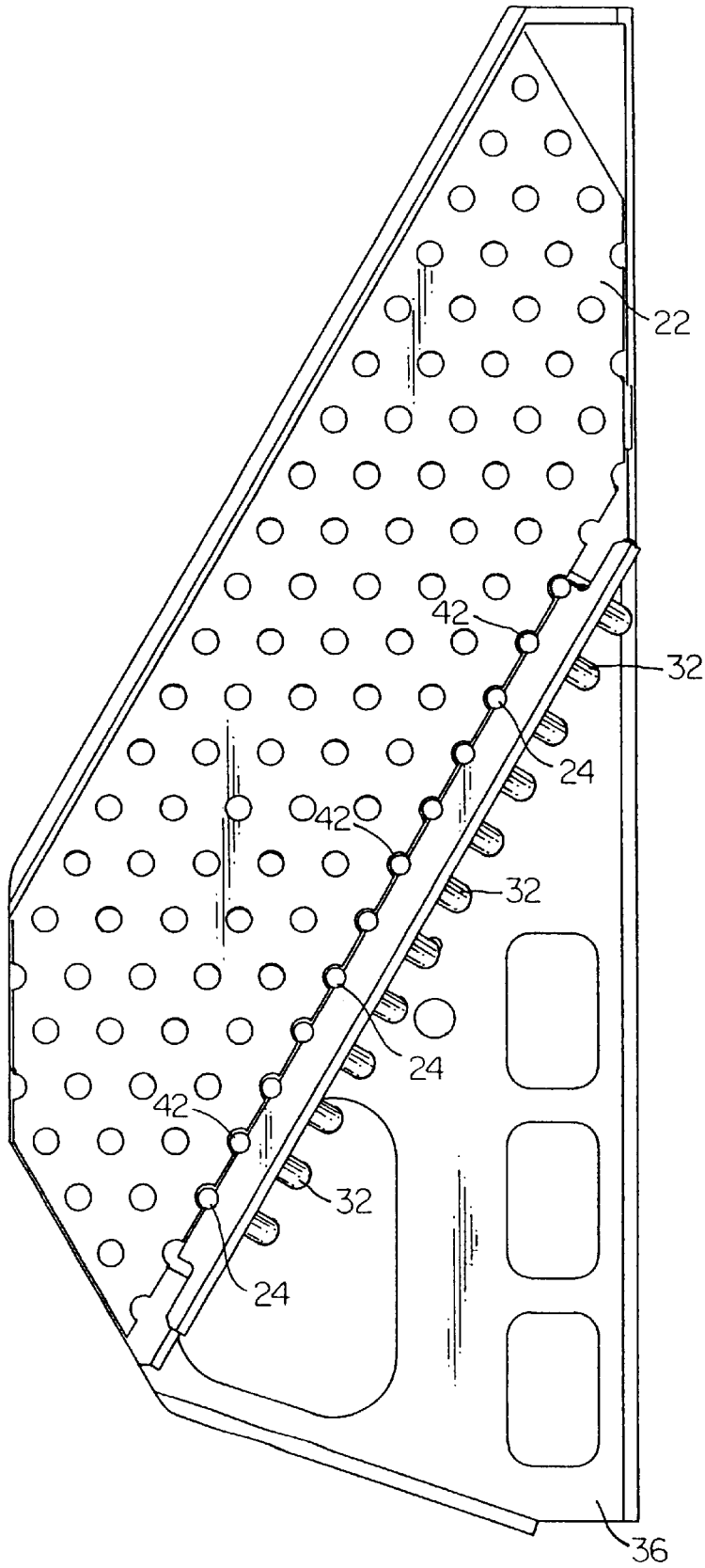
FIG. 5 is a sectional view of the coil of FIG. 4 taken along line 5—5.

In FIG. 5, which is a sectional view of FIG. 4, taken along a lines 5—5, the location and function of the rods with respect to the evaporator fins is shown in greater detail. It can be seen that the array of the rods uniformly covers a major portion of the surface area of the coil, and in the embodiment illustrated, the coils have been cut at 42 to allow the rod to nest in direct contact in a positive secure fit within the coil. This configuration also provides for a even flow of conductive heat from the rods to the coil.

Figure 6:
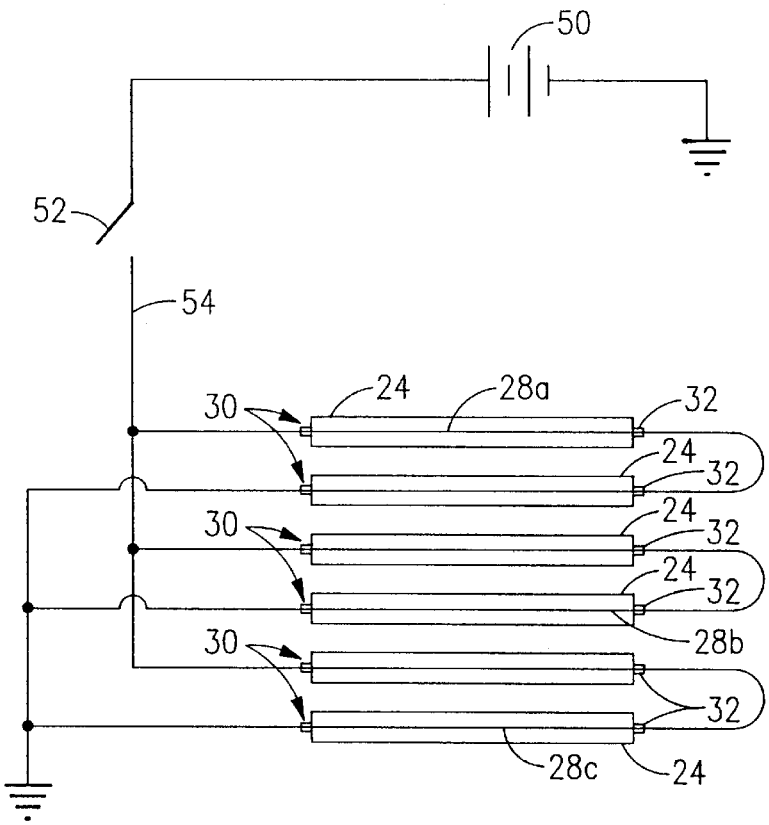
FIG. 6 is a schematic diagram of a circuit supplied with a DC voltage controlling the heating rods of the present invention, wherein each conductor is routed through a tube pair.

Referring to FIG. 6, a DC voltage supplied circuit comprises a voltage source 50, a switch 52 that opens and closes on demand or alternatively in response to predetermined conditions, a conductor 54 that connects via connectors 30 to each heat dissipating conductor 28, portrayed as three separate conductors 28*a,* 28*b,* and 28*c*. Each conductor 28 runs serially through two rods, electrically connected between each rod by a pair of connectors 32. Each conductor terminates in a connector 30 that is connected to ground.

Figure 7:
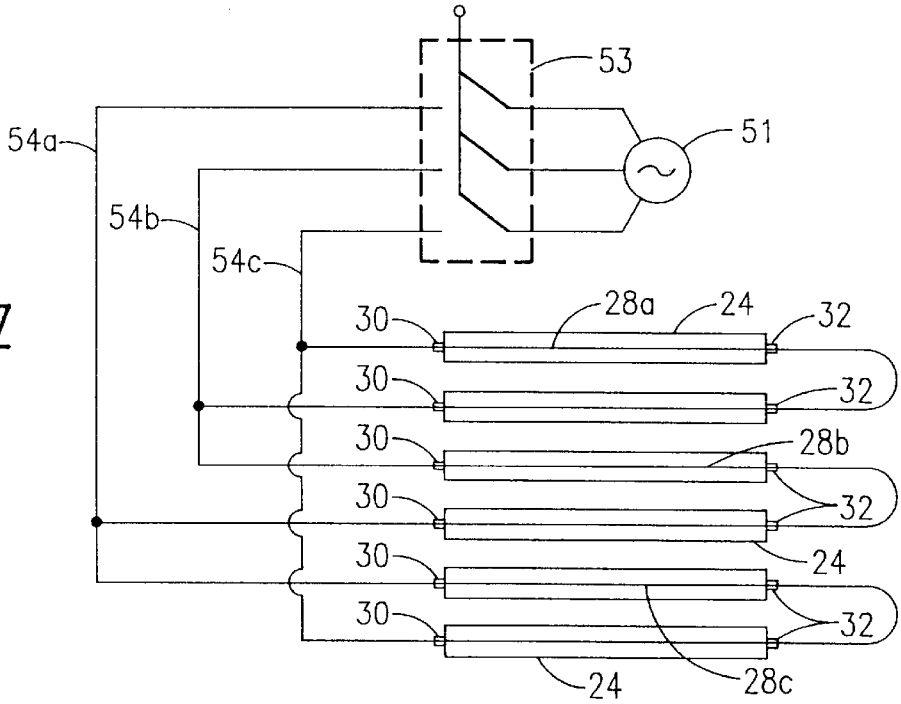
FIG. 7 is a schematic diagram of a circuit supplied with an AC voltage controlling the heating rods of the present invention, wherein each conductor is routed through a tube pair.

Referring to FIG. 7, an AC voltage supplied circuit comprises a voltage source 51 (portrayed here as three phase AC), a switch 53 that opens and closes on demand or alternatively in response to predetermined conditions, conductors 54*a,* 54*b,* and 54*c* that each connect a different phase of the voltage source and connect via connectors 30 to two of the three separate heat dissipating conductors 28, portrayed as separate conductors 28*a,* 28*b,* and 28*c*. Each conductor 28 runs serially through two rods 24 that are electrically connected between rods by a pair of connectors 32.

Figure 11:
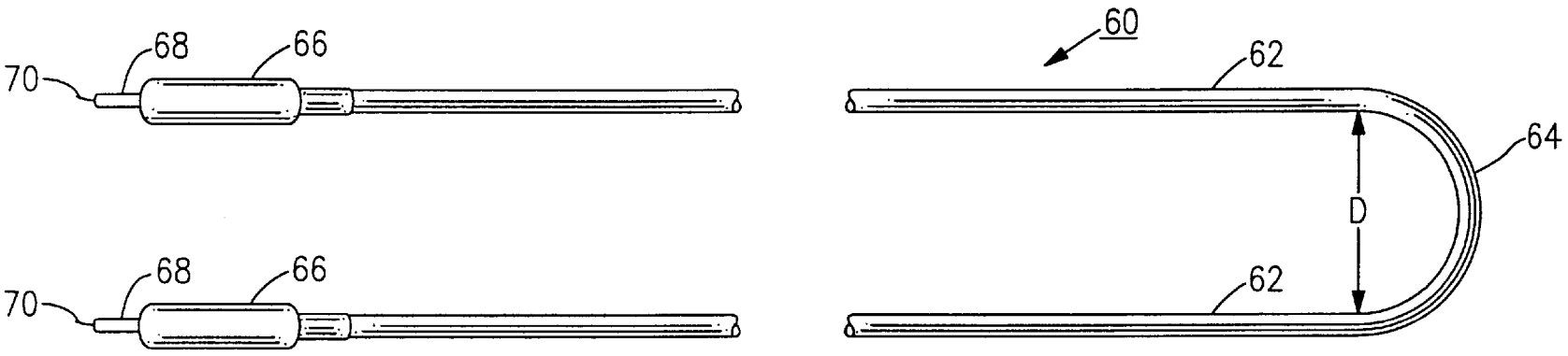
FIG. 11 is a top view of a rod pair of the prior art.
Figure 12:
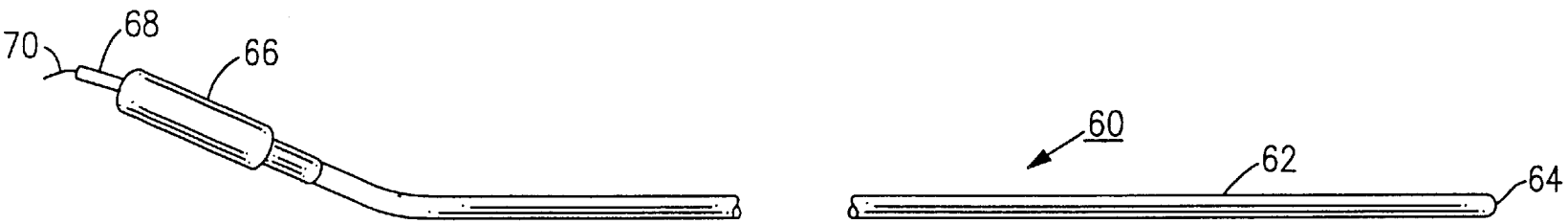
FIG.12 Prior Art
FIG. 12 is a side view of the rod pair shown in FIG. 11.

FIGS. 11 and 12 represent the state of the prior art in which a rigid, substantially inflexible rod pair 60 having two metal rods 62 forming a stiff inflexible continuous U-shaped end 64 are used in pairs and partially embedded in an evaporator coil. The width or dimension D illustrated in FIG. 11 is a substantially constant dimension which must be maintained to fit in the notch or holes 42 in the coil fin. Any slight deviation from the exact required dimension results in a misfit or mismatch. Therefore, if the dimensions of the given rod pair, whether it be newly manufactured or a replacement, does not exactly match the dimension of the receiving notches or holes on the evaporators fins, there can be great difficulty in removing or installing a rod pair of this type during manufacturing or servicing.

Figure 8:
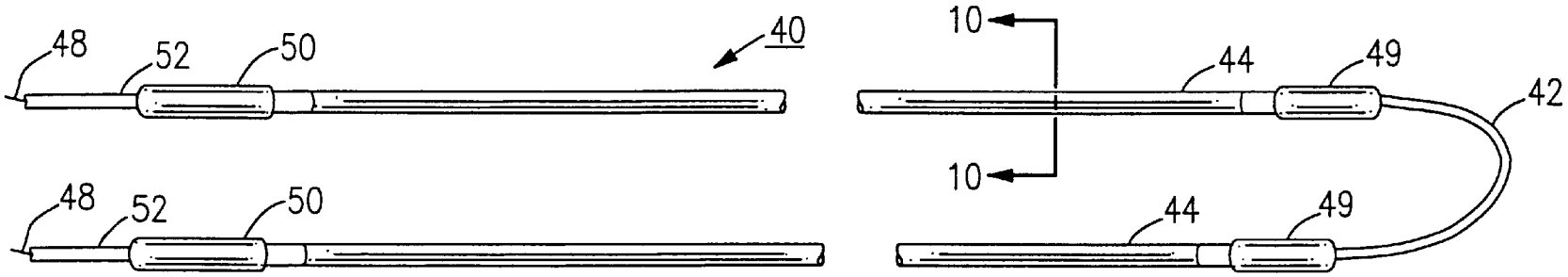
FIG. 8 is a top view of a preferred embodiment of the rod pair or the present invention.
Figure 9:
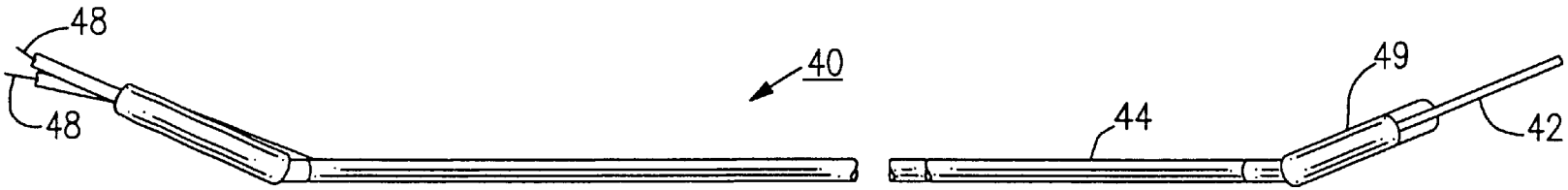
FIG. 9 is a side view of the rod pair shown in FIG. 8.
Figure 10:
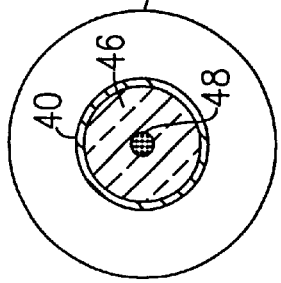
FIG. 10 is a cross sectional view of the metal rod of FIG. 8 taken along line 10—10.

As shown in FIGS. 8–10, according to a preferred embodiment of the present invention, the rod pair 40 has a flexible rubberized connection 42 at one end of the rod pair which allows for the evaporator coil assembly to be manufactured with more efficiency and also facilities ease of servicing in that the flexible end 42 allows for ease of movement of the two metal side rods 44. Therefore, in manufacturing an evaporator coil assembly or in servicing, such as replacing a defective or broken rod pair, the flexible end 42 does not require an exact dimensional fit when partially embedded in the coil fins in that there is enough flexibility in the rubberized end to accommodate any dimension which is reasonably close. The main rod structure, as illustrated in FIG. 9 is typically a conductive metal wire 48, such as copper surrounded by a ceramic material 46, having an outer metal sheath 44 such as stainless steel. The flexible rubber end 42 surrounds the conductive wire and is connected to a larger vulcanized rubber connector 49. The opposite end of the rod pair contains a rubberized connector 50 over wire 48 which at the end of the rod, is encased in a smaller diameter rubberized sheath 52.

The present invention may be used with any conventional refrigeration unit. One example of such a unit is more clearly shown in the Carrier Corp., Transicold Division Operation and Service Manual for Models 69NT40511 and 69NT40521 which is incorporated herein by reference. In particular page 1–7 of the manual illustrates in detail the key operative components of a suitable evaporator unit which may utilize the present invention.

While specific embodiments of the invention have been illustrated and described herein, it is realized that modifications and changes will occur to those skilled in the art. It is therefore to be understood that the appended claims are intended to cover all modifications and changes as fall within the true spirit and scope of the invention.

What is claimed is:

1. An evaporator coil assembly for a refrigeration system which includes an evaporator coil having a plurality of contiguous metal cooling fins and means for providing heat to said cooling fins on demand or under a predetermined condition, said heating means including a plurality of interconnected electrically heated metal rods which are at least partially embedded at a predetermined location in the outer surface of said cooling fins, the improvement comprising wherein said rods are electrically connected in pairs by a common electrical connection at one end to provide resistive heating to said coil, while said rod pairs are flexibly connected at their opposite ends by a resilient rubberized member to facilitate installation and replacement of a given rod pair.

2. The evaporator coil assembly of claim 1, wherein said plurality of electrically heated rods are elongated and are arranged in a parallel array in said fins.

* * * * *